US005564451A

United States Patent [19]

Hagberg

[11] Patent Number: 5,564,451

[45] Date of Patent: Oct. 15, 1996

[54] FOREARM CRUTCH

[76] Inventor: Nils G. Hagberg, 4219 Maple Ave., Oakland, Calif. 94602-4046

[21] Appl. No.: 391,533

[22] Filed: Feb. 21, 1995

[51] Int. Cl.[6] ..... A61H 3/02

[52] U.S. Cl. ..... 135/68; 135/71

[58] Field of Search ..... 135/68, 66, 71, 135/72, 74, 75

[56] References Cited

U.S. PATENT DOCUMENTS

| | | | |
|---|---|---|---|
| 1,244,249 | 10/1917 | Schlick | 135/71 |
| 2,575,681 | 11/1951 | Peters | 135/68 |
| 2,711,183 | 6/1955 | Lofstrand | 135/50 |
| 2,788,793 | 4/1957 | Abbott | 135/68 |
| 2,811,978 | 11/1957 | Russell | 135/45 |
| 3,157,187 | 11/1964 | Murcott | 135/49 |
| 3,157,188 | 11/1964 | Farnham | 135/50 |
| 3,157,189 | 11/1964 | Farnham | 135/50 |
| 3,486,515 | 12/1969 | Chrysostomides | 135/50 |
| 3,635,233 | 1/1972 | Robertson | 135/71 |
| 3,710,807 | 1/1973 | Ferry | 135/49 |
| 3,731,920 | 5/1973 | Matsuda | 272/57 E |
| 3,757,807 | 9/1973 | Manzo | 135/47.5 |
| 3,768,495 | 10/1973 | Smith | 135/51 |
| 3,995,650 | 12/1976 | DiVito | 135/72 |
| 3,999,565 | 12/1976 | Delacour | 135/65 |
| 4,085,763 | 4/1978 | Thomas | 135/69 |
| 4,151,853 | 5/1979 | Inbar | 135/71 |
| 4,237,915 | 12/1980 | Zabielski et al. | 135/68 |
| 4,237,916 | 12/1980 | Harrison et al. | 135/69 |
| 4,248,256 | 2/1981 | Thomas | 135/67 |
| 4,434,808 | 3/1984 | Burak | 135/80 |
| 4,510,957 | 4/1985 | Frank | 135/84 |
| 4,708,154 | 11/1987 | Edwards | 135/84 |
| 4,869,280 | 9/1989 | Ewing | 135/74 X |
| 4,958,651 | 9/1990 | Najm | 135/82 |
| 5,036,873 | 8/1991 | Clayton | 135/69 |
| 5,038,811 | 8/1991 | Gilmore | 135/71 |
| 5,139,040 | 8/1992 | Kelly | 135/69 |
| 5,178,176 | 1/1993 | Fetterman | 135/86 |
| 5,193,567 | 3/1993 | Razny, Jr. | 135/68 |
| 5,287,870 | 2/1994 | Rhodes | 135/72 |
| 5,291,910 | 3/1994 | Cuong | 135/68 |
| 5,299,589 | 4/1994 | Zatulovsky | 135/68 |
| 5,329,954 | 7/1994 | Miyoshi | 135/72 X |
| 5,339,849 | 8/1994 | Stutz | 135/66 |
| 5,339,850 | 8/1994 | Mertz | 135/72 |
| 5,351,702 | 10/1994 | Denjean | 135/71 |

FOREIGN PATENT DOCUMENTS

| | | | |
|---|---|---|---|
| 8900039 | 1/1989 | WIPO | 135/71 |

*Primary Examiner*—Lanna Mai
*Attorney, Agent, or Firm*—Michael J. Mazza

[57] ABSTRACT

A walking aid or crutch which comprises a vertical support member which preferrably incorporates a shock-absorbing means therein, and a forearm support, angularly mounted on the vertical support member over an angular range of about 25 to 89 degrees from the vertical to optimize weight distribution and user comfort. The forearm support comprises a linearly adjustable forearm cradle and a handle, to further optimize weight distribution, stability and user comfort. The handle may be angled inward toward the center line of the body so that the user's forearm is pronated about five degrees, with weight distributed along the ulnar edge of the forearm adjacent to the elbow joint, and the ulnar border of the hand (fifth metacarpal) is also pronated about five degrees as the fingers engage the support arm handle. The handle may also have a downward angle (in the direction of motion) to create an ulnar deviation of about fifteen degrees beginning at the wrist joint as the hand engages the handle.

18 Claims, 3 Drawing Sheets

FOREARM CRUTCH

1. Field of Invention This invention relates to crutches or walking aids; and specifically to an improved forearm-type or "Canadian" crutch.

2. Discussion of Related Art

Forearm crutches have traditionally been made in various fixed lengths. Improvements to the crutch have focused on making the length of the crutch adjustable, for example, as shown by Harrison-Smith, et al. U.S. Pat. No. 4,237916 and Inbar, U.S. Pat. No. 4,151,853. A patent for making a crutch collapsible was issued to Ewing, U.S. Pat. No. 4,869,280. Different types of locking mechanisms to control crutch length, for example Ferry, U.S. Pat. No. 3,710,807, have also been granted.

Further patents have addressed different types of tips to improve crutch stability when it makes contact with ground. U.S. Pat. No. 5,038,811 to Gilmore describes modifying the cuff to make it self-opening. The shape of the grip/handle, Rhodes, U.S. Pat. No. 5,287,870; Inbar, U.S. Pat. No. 4,151,853; and Mertz, U.S. Pat. No. 5,339,850, has also been modified. The type of material used in the grip varies. However, the basic design of the forearm crutch, shown in Lofstrand, U.S. Pat. No. 2,711,183, has not significantly changed since 1955.

A major fundamental problem of the forearm crutch as it now exists is that the user must support all of the body's weight through the hands causing the user to position the body with the shoulders forward, or protracted, resulting in poor spinal alignment for walking. As a result, some individuals are unable to use the forearm crutch due to their lack of physical strength. For those who can use the crutch, a major problem reported is physical fatigue and numbness of the hands. The numbness is associated with nerve and circulatory problems due to the weight borne by the hands. With the shoulders rolled forward in the protracted position, other physiological problems of the neck, back and spine may develop, further compromising the individual's physical health. While the prior art has addressed improving the various components of the forearm crutch, none has addressed the physiological problems incurred by the user.

SUMMARY OF THE PRESENT INVENTION

The present invention provides an improved forearm crutch which affords the user greater ease of use through reduction in the weight that must be borne by the user's hands. The user's weight is supported by a colinear forearm cradle and handle, angularly mounted on a vertical support. The handle may be angled inward toward the center line of the body so that the user's forearm is pronated about five degrees, with weight distributed along the ulnar edge of the forearm adjacent to the elbow joint, and the ulnar border of the hand (fifth metacarpal) is also pronated about five degrees as the fingers engage the support arm handle. The handle may also have a downward angle (in the direction of motion) to create an ulnar deviation of about fifteen degrees beginning at the wrist joint as the hand engages the handle.

It is accordingly an object of the walking aid of the present invention that the weight of the body borne by the hands is substantially reduced.

It is another object of the present invention that the user's shoulders are urged back, or retracted, thereby resulting in a proper spinal curvature for walking.

It is a further object of the present invention that user comfort is enhanced, while maintaining good stability.

It is yet another object of the present invention that it can be readily adjusted to optimize comfort and stability for users of varying size and physiological conditions.

It is yet another object of the present invention that it is simple to manufacture.

Briefly, in a first embodiment of the present invention, the crutch generally comprises a vertical elongate support which preferrably incorporates a shock-absorbing means therein, and a forearm support, which is adjustably fixed to the vertical elongate support over an angular range of about 1 to 75 degrees downward from a horizontal plane to optimize weight distribution and user comfort. The forearm support comprises a forearm cuff and a hand grip, linearly adjustable relative to each other to further optimize weight distribution and user comfort. The crutch of the present invention is constructed of a strong, lightweight material such as a light metal alloy or plastic. Weight can be further decreased by tubular construction and/or by reducing material thickness or material removal as appropriate.

It is accordingly an advantage of the walking aid of the present invention that the weight of the body borne by the hands is substantially reduced.

It is another advantage of the present invention that the user's shoulders are urged back, thereby resulting in a proper spinal curvature for walking.

It is a further advantage of the present invention that user comfort is enhanced while stability is maintained.

It is yet another advantage of the present invention that it can be readily adjusted to optimize comfort and stability for users of varying size and physiological conditions.

It is yet another advantage of the present invention that it is simple to manufacture.

It is another advantage that the crutch of the present invention is does not require extensive user manipulation, making it well suited to those who are unable to do so, or for whom manipulation difficulties are compounded by the need to employ two crutches.

These and other objects and advantages of the present invention will no doubt become obvious to those of ordinry skill in the art after having read the following detailed description of the preferred embodiment as llustrated by the various drawing figures.

IN THE DRAWINGS

DETAILED DESCRIPTION OF THE PREFERRED EMBODIMENTS

Figure 1:
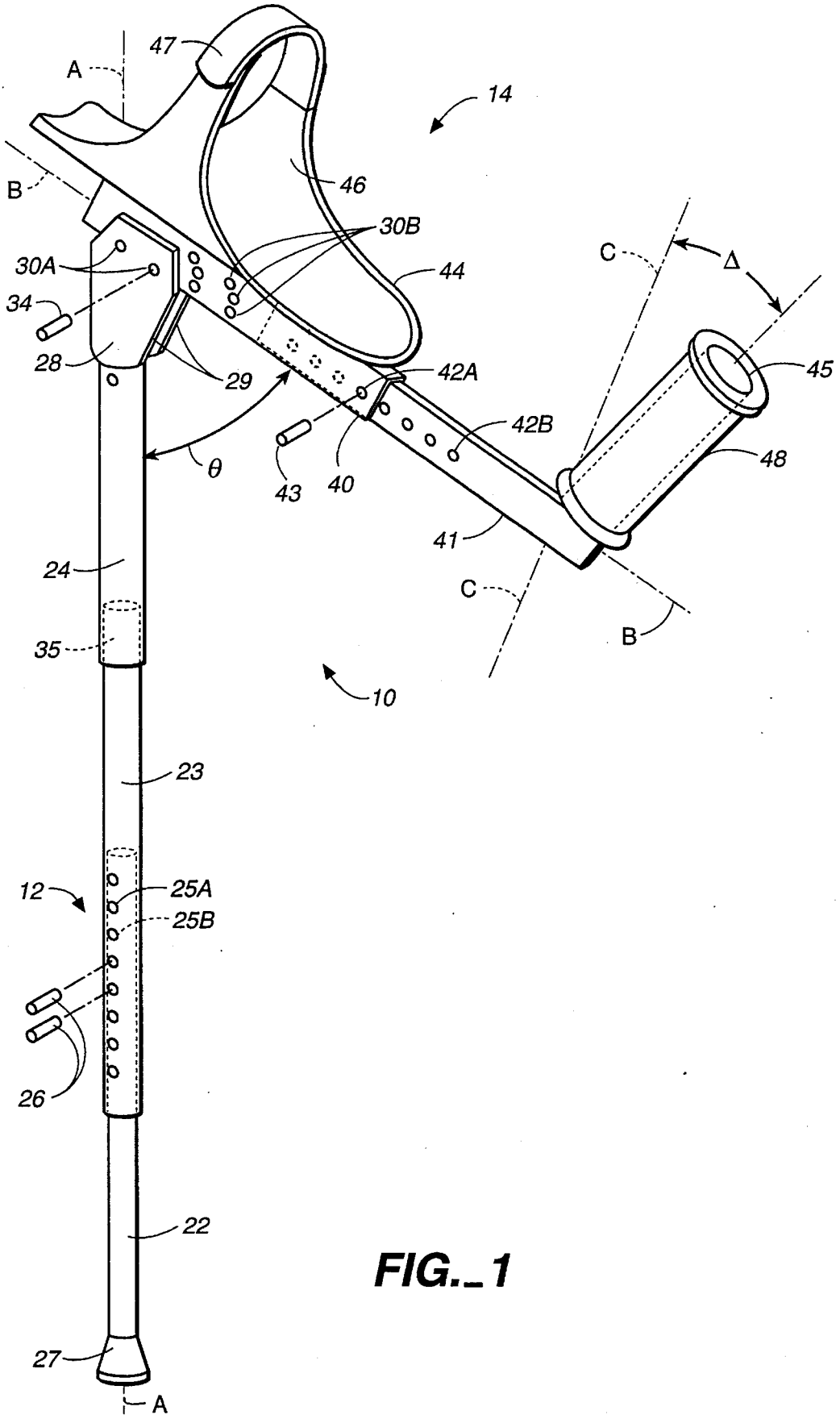
FIG. 1 is a perspective view of the crutch of the present invention.

Referring to the drawings, and in particular to FIG. 1, there is shown a crutch or walking aid of the present invention and referred to by the general reference numeral 10. The walking aid 10 comprises a generally vertically-disposed vertical elongate shaft 12 and a generally angularly disposed forearm support 14.

The vertical elongate support 12 has a central vertical axis AA, and preferrably comprises a lower shaft 22 for contacting a walking surface, an intermediate shaft 23 which engages the lower shaft 22, and an upper shaft 24 which also engages the intermediate shaft 23, and which further engages the forearm support 14. The shafts 22 and 23 communicate in a telescoping fashion to provide a means of adjusting the overall height of the walking aid 10. The height adjustment may be through any means known to the art to achieve the height adjusment on either an incremental or continuous basis. An internally expandable friction lock could be used to provide continuous height adjustment. For manufacturing simplicity an incremental or stepwise adjustment is preferred, such as one or more threaded fasteners and locknuts, detents or self-locking, e.g. clevis pins. A pin and corresponding aperature arrangement, as shown in FIG. 1, is most preferred. Thus the shafts 22 and 23 each contain a series of regularly spaced apertures 25A and 25B, respectively, through which a pin or pins 26 may be inserted to secure the shaft 22 to the shaft 23. If desired, the pin 26 may be integrally formed into the shaft 22 or 23 and a spring or other suitable biasing means (not shown) may be incorporated to impart a self-locking capability to the pin 26. Alternatively, the pins 26 and aperatures 25A and/or 25B may be threaded to permit locking. A lower or distal end of the shaft 22 may include a resilient, shock absorbing and anti-skid tip 27, formed preferably of a rubber or plastic material. At an upper or proximal end of the shaft 24 there is a angular support means 28 for pivotably affixing the vertical elongate support 12 to the forearm support 14. The angular support means 28 includes adjustment means to allow a user to alter the angle of the forearm support 14 relative to the vertical elongate support 12, and further for allowing the user to position the forearm support 14 about a longitudinal dimension thereof. Referring to FIG. 1, the angular support means 28 comprises a generally flat plate 29 secured to the proximal end of the shaft 24, and in the most preferred embodiment comprises two congruent opposed plates 29 with the forearm support 14 engaged intermediate thereto. In the preferred embodiment, the adjustment means comprises a pair of apertures 30A through the plates 29 which align with a pair of apertures 30B of the forearm support 14, and are locked together by a pair of locking pins 34 (illustrated also in FIG. 2). The vertical elongate support is also preferably supplied with a shock absorbing means 35 to soften forces transmitted to user through the forearm support 14 as the user walks.

The forearm support 14 comprises a pair of arms 40 and 41 which slidebly mate in a telescoping manner and through which runs a central longitudinal axis BB. A forearm cuff 44 is secured to the arm 40, and a handle 45 is secured to the arm 41. The arms 40 and 41 possess a securing or locking mechanism such as disclosed hereinbefore with reference to the vertical support 12, and preferably comprise paired apertures 42A and 42B, formed through arms 40 and 41 respectively, and secured by a pin or pins 43. It is to be noted that any of the locking or securing means disclosed herein may be utilized for locking or securing any two movible parts of the present invention. The cuff 44 comprises an arcuate forearm cradle 46 shaped to be generally congruent to a lateral or ulnar surface of a human forearm. The cradle 46 is designed to maximize contact with a user's forearm for weight distribution, and is formed of a supportive, yet resilient material, such as a plastic or rigid fabric. Preferably, a central portion of the cradle 46 curves upwardly to engage and support the forearm about a surface over the ulna bone (ulnar surface.) The cradle 46 preferably includes an arm restraining means such as a strap 47 to encircle the forearm about a surface above the radius bone (radial surface) thereby securing the user's arm thereto. By slidably positioning the arms 40 and 41, the cuff 44 and handle 45 are linearly adjustible with respect to each other to optimize weight distribution and user comfort. The handle 45 is sized to permit a user to grip it, and is preferably covered with a resilient material 48 such as a rubber or plastic. It is also preferred that the handle 45 be tilted slightly downward relative to a perpendicular axis CC (which is coplanar with axes AA and BB and perpendicular to axis BB) such that an angle delta (Δ) is formed (depicted also in FIG. 2) of between about 0 and 40 degrees, preferably about 1–30 degrees, more preferably about 5–20 degrees, and most preferably about 10–18 degrees. The handle 45 may also be inclined slightly inward toward the user, in a direction perpendicular to axes CC and BB. This inclination should be between about 0–20 degrees, preferably about 1–15 degrees and most preferably about 3–8 degrees. Ideally, the combined result of the downward tilt and inward inclination is that the user's ulnar border of the hand (fifth metacarpal) is pronated about five degrees, while there is an ulnar deviation of about fifteen degrees beginning at the wrist joint, as the fingers engage the handle 45. Generally, it is contemplated that the handle 45 is fixed at preselected downward and inward angles, however it is within the scope of the invention to supply an adjustment means, such as a lockable ball joint, or any other disclosed herein, to the handle 45 to permit such alignment by the user.

The strap 47 may be a one piece elastomeric material so that the user can simply slip the forearm therethrough along axis BB, or it may be separable such that the user can position the forearm into the cuff 44 from the top, that is along axis CC. In this case the strap 47 should be made to permit one-handed securing and releasing, as if made from an interlocking material such as VELCRO, for example. Alternatively, the strap 47 may be two opposed congruent pieces of a semi-rigid material such as plastic or stainless steel strap, which will be sufficiently yielding to permit the user to insert the forearm from the top, but which will then spring back to retain the forearm. This has the advantage of not requiring manipulation by the user's other arm and hand.

Figure 2:
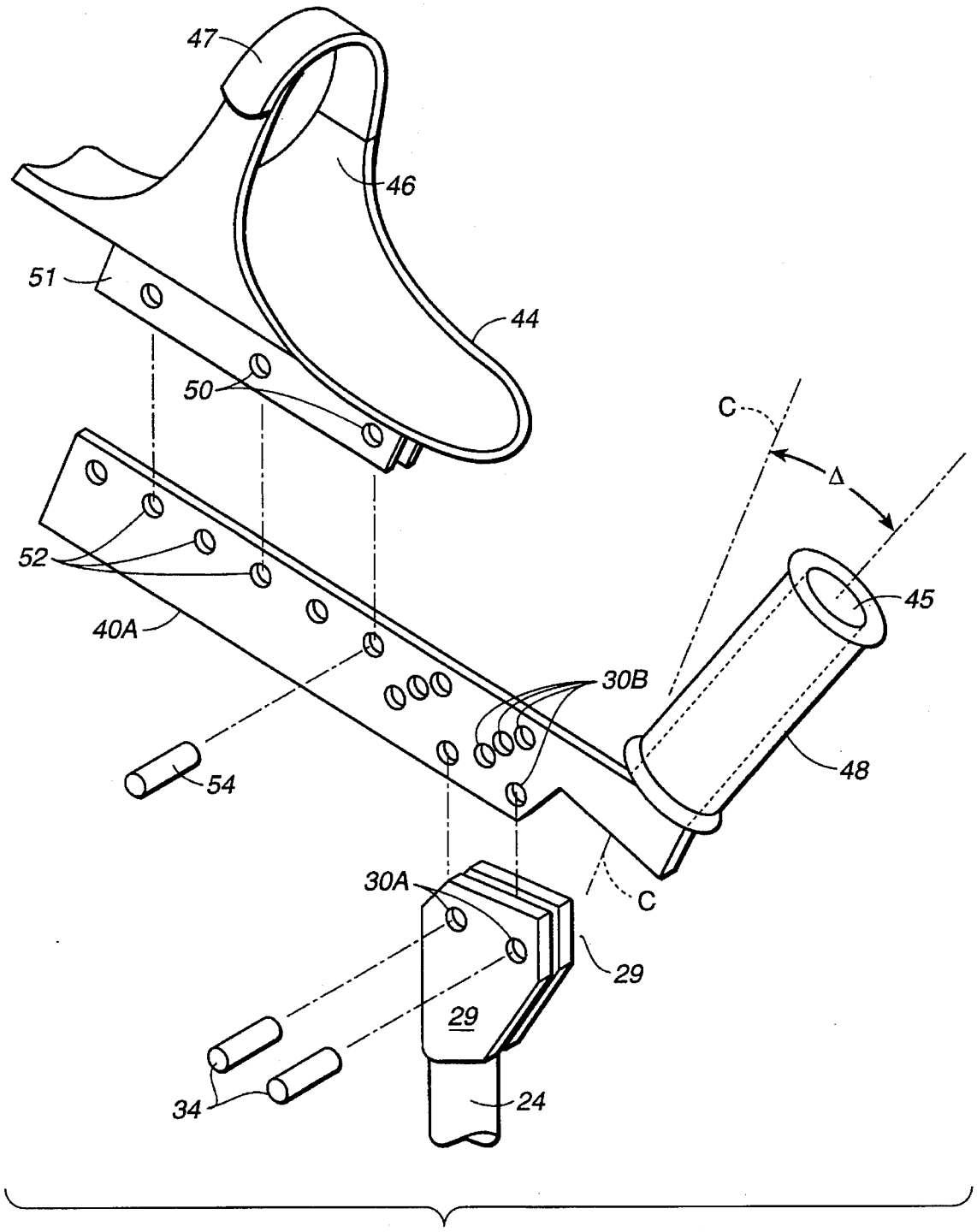
FIG. 2 is an exploded detail view of an alternative embodiment of the forearm support of FIG. 1.

In an alternative embodiment of the forearm support, depicted in FIG. 2, there is a single arm 40A, with the handle 45 fixed thereto, for example by forming from a single piece of material, such as aluminum or a plastic. The cuff 44 is slidably mounted on the arm 40A to provide lateral adjustibility along axis BB. Provision for such lateral adjustment is supplied by any means known to the art, for example as disclosed hereinbefore in connection with securing the shafts 22 and 23, and in the preferred embodiment comprises one or more apertures 50 formed through a bracket 51 of the cuff 44, which align with a corresponding number of apertures 52 in the arm 40A, and are secured by pins 54.

Referring again to FIG. 1, the forearm support 14 is secured to the lower elongate support 12 via the angular support 28, and can be adjusted such that an angle theta (θ) formed by axes AA and BB (depicted in FIG. 1) is between about 25–89, preferably between about 30–85, more preferably between about 45–80 degrees, and most preferably is about 70–75 degrees. Preferrably, the vertical support 12 can be attached to the forearm support 14 at any point along the support arm 40. It has been found that user stability and comfort are both at an optimum when the vertical elongate support 12 is attached to the arm 40 at a point distal to the handle 45 and posterior to a midpoint of the forearm cradle 46. Most preferred is to locate the support 12 posterior to a substantial portion of the cradle 46, placing the vertical elongate support 12 generally under the user's elbow. In practice, the position of the forearm support 14 relative to the vertical elongate support 12 is satisfactory if about five centimeters, preferably about 2–3 centimeters, posterior to a midpoint of the cradle 46. Under dynamic load conditions (i.e. walking) in this configuration, flexing of the vertical support 12 is minimized or eliminated, thus minimizing or eliminating the resulting change such flexing would induce in the preselected angle θ of the forearm support 14.

Figure 3:
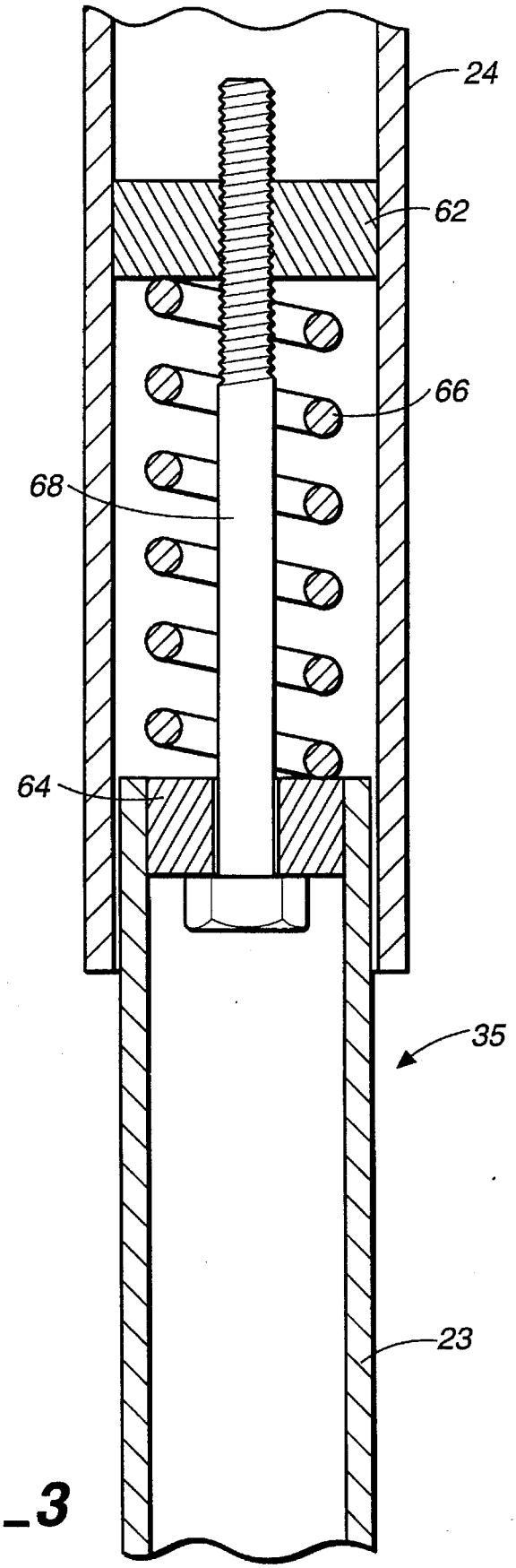
FIG. 3 is a detail view, in partial cutaway, of the shock absorbing means of the vertical elongate shaft.

For purpose of enhancing user comfort, the vertical support 12 is preferrably provided with the shock absorbing means 35, shown in more detail in FIG. 3. The shock absorbing means 35 may be positioned at anywhere about the lower elongate support 12 as known to the art, and in the preferred embodiment is intermediate to the lower shaft 22 and the intermediate shaft 23. Most preferably, as depicted in FIG. 3, the shock absorbing means 35 includes a disk 62 secured within the upper shaft 24, the disk 62 having a central threaded aperture. Intermediate shaft 23 also contains a fixed disk 64 with a central aperture. A spring 66, having a diameter just slightly less than an inside diameter of the upper shaft 24 is contained therein such that the spring 66 may freely expand and compress vertically. An upper end of the spring 66 abuts the disk 62, while a lower end of the spring 66 abuts the disk 64, as the intermediate shaft 23 telescopes into a lower end of the upper shaft 24. The intermediate shaft 23 is secured to the upper shaft 24 by a bolt 68 which passes through the disk 64 and is threaded into the disk 62. By removing the intermediate shaft 23 from the upper shaft 24, the user can turn the bolt 68 to control the amount of force required to compress the spring 66, thereby controlling the distance the intermediate shaft 23 can move vertically. It is also within the scope of the present invention to provide a non-adjustible shock absorbing means 35, such as by inserting a solid elastomeric material intermediate to at least two of the shafts 22, 23 or 24, or intermediate to the forearm support 14 and the vertical support 12.

It is also peferred that the crutch be adjusted as described above such that certain phsiological conditions are attained for optimum user stability and comfort. Ideally, the positioning of the user's arm within the forearm cuff 44, and hand position resulting from the downward tilt and inward inclination of the handle 45, is that the user's ulnar border of the hand (fifth metacarpal) is pronated about five degrees, while there is an ulnar deviation of about fifteen degrees beginning at the wrist joint, as the fingers engage the handle 45. In general, user stability is maximized as the angle θ formed by the vertical support 12 and the forearm support 14 approaches the minimum of about 25 degrees, and the user's elbows are at there point of fullest extension. On the other hand comfort is maximized with the reverse conditions, i.e. a large angle θ (89 degrees) and greatest elbow flex angle. Additionally, stability is best with the vertical elongate support 12 positioned posterior to the forearm cradle 46, as closely as possibly to be under the user's elbow.

EXPERIMENTAL

To determine the effectiveness of weight transfer from the user's hands to forearm, strain gauges were placed about the handle 45 and the walking aid employed to support the body weight. Static and dynamic strain measurements were made to ascertain the load borne by the user's hands at various angles of the forearm cradle 46 relative to the vertical elongate support 12. A Micro Engineering PA06-25OBB-35OEN strain gauge mounted on the handle 45 proximal to the user's hand. Utilizing a nine volt direct current power supply, a Wheatstone Bridge with adjustable three hundred and fifty ohm resistors on each leg was connected to the strain guage, and an ammeter was connected to the Wheatstone bridge to measure changes in micro amperage as the strain gauge was placed under load. The vertical elongate shaft 12 was attached to the forearm support 14 at a point five centimeters behind the handle 45. Various angles θ were tested and results are shown in the Table I below. Table I shows the results of static testing under the conditions outlined above.

TABLE I

| Angle of Support (Degrees) | 25 | 50 | 75 |
|---|---|---|---|
| Body Weight Supported by Forearm (Percent) | 2 | 29 | 43 |

It can be readily seen that the forearm crutch of the present invention effectively reduces weight borne by the user's hands as the support angle θ approaches the maximum of about eighty-nine degrees as measured from the vertical.

Dynamic testing was also conducted, with test subjects utilizing a swing-through gait of both legs simultaneously so that essentially no body weight was supported by the legs. The subject moved forward at a velocity of three feet per second. Strain guage measurements were taken as above. Results are shown in Table II below.

TABLE II

| Angle of Support (Degrees) | 25 | 50 | 75 |
|---|---|---|---|
| Body Weight Supported by Forearm (Percent) | 2 | 32 | 52 |

Under dynamic load, with the vertical elongate shaft 12 five centimeters behind the handle 45, the vertical shaft flexed, increasing the preselected angle θ of the forearm support up to approximately twenty degrees.

Tables III and IV show results obtained under static and dynamic load conditions, respectively, when the vertical shaft was attached to the support arm directly beneath the user's elbow joint. All other conditions, and strain guage measurements were as above.

TABLE III

| Angle of Support (Degrees) | 25 | 50 | 75 |
|---|---|---|---|
| Body Weight Supported by Forearm (Percent) | 2 | 29 | 43 |

TABLE IV

| Angle of Support (Degrees) | 25 | 50 | 75 |
|---|---|---|---|
| Body Weight Supported by Forearm (Percent) | 2 | 32 | 43 |

Under dynamic load, the vertical shaft 12 did not flex, and the angle θ of the forearm support 14 beneficially remained at its preselected value.

Some test subjects who needed the forearm crutch primarily for weight support (as opposed to maintaining balance) reported that the crutch of the present invention felt more stable when the vertical shaft was attached to the forearm support beneath the elbow. When the angle θ of the forearm support was set at 25 degrees, the user's elbows were flexed to 165 degrees. When the angle θ of the forearm support was set at 40 degrees, the user's elbows were flexed to 140 degrees. When the angle θ of the forearm support was set at 75 degrees, the user's elbows were flexed to 115 degrees. In general, user stability, especially in the dynamic mode is maximized as the angle θ approaches the minimum of about 25 degrees, and the user's elbows are at their point of fullest extension or greatest flex angle. On the other hand comfort is maximized with the reverse conditions, i.e. a large angle θ of 89 degrees and smallest flex angle of the elbow.

It can be seen that the walking aid of the present invention is effective to transfer at least 30 percent of the user's weight from the hands to the forearm, preferably at least 40 percent more preferably at least 50 percent and most preferably at least about 60 percent of the weight is transferred to the forearm.

Other embodiments of the invention would become readily apparent to one skilled in the art. For example, since the walking aid of the present invention is easy to manufacture, the vertical elongate shaft could be formed as a single piece thus obviating the need for a height adjustment. Various lengths could thus be premanufactured and selected to fit the user. Similarly, the forearm support assembly could be manufactured as a unitary piece of various fixed lengths. The forearm cuff could be extended about the axis BB, so that forearms of various lengths could be comfortably accomodated, thus eliminating the need for adjustable sections.

Although described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

What is claimed is:

1. A walking aid comprising a vertical elongate support, having a lower end adapted for contact with a walking surface, and an upper end being adjustably secured to a forearm support;

a forearm support comprising a handle and a forearm cuff, said forearm cuff includes a cradle, the handle and forearm cuff being linearly disposed about a longitudinal axis and being inclined relative to the vertical elongate support by an angle of between about 25 and 89 degrees; the vertical elongate support being secured to the forearm support at a point intermediate to said handle and posterior to a substantial portion of said cradle; and wherein at least about 30 percent of the user's body weight is substantially transferred to said walking surface through the forearm support.

2. The walking aid of claim 1 wherein:

the forearm cuff comprises an arcuate forearm cradle, generally congruent to an ulnar surface of a user's forearm, and a restraining means for securing said user's forearm therein.

3. The walking aid of claim 2 wherein the vertical support is secured to the forearm support about a point posterior to the forearm cradle.

4. The walking aid of claim 1 wherein the handle of the forearm support is tilted downward by an angle of between about 0–40 degrees, and is inclined inwardly toward the user by an angle of between about 0–20 degrees.

5. The walking aid of claim 4 wherein said downward tilt and inward inclination of the handle urges an ulnar border of the user's hand to be pronated about five degrees, and an ulnar deviation of about fifteen degrees.

6. The walking aid of claim 1 wherein the vertical elongate support comprises an upper shaft in contact with the forearm support, a lower shaft for contacting the walking surface, and an intermediate shaft, intermediate to and in contact with the upper and lower shafts and in telescoping contact with at least one of the upper and lower shafts whereby the vertical support is adjustable in length.

7. The walking aid of claim 6 wherein the upper, lower and intermediate shafts are formed of a tubular material, each of said shafts mating in a telescoping fashion.

8. The walking aid of claim 7 further including a resilient tip affixed to a lower end of the lower shaft.

9. The walking aid of claim 1 wherein the handle includes an outer layer of resilient material to facilitate gripping thereof.

10. The walking aid of claim 1 and further including a compressible shock absorbing means within the vertical elongate shaft.

11. The walking aid of claim 10 wherein the shock absorbing means comprises a biasing means disposed intermediate to the upper and intermediate shafts.

12. The walking aid of claim 1 wherein at least about 40 percent of the user's body weight is transferred to said walking surface through the forearm support.

13. The walking aid of claim 1 wherein at least about 50 percent of the user's body weight is transferred to said walking surface through the forearm support.

14. A walking aid comprising a vertical elongate shaft, having a lower end adapted for contact with a walking surface, and an upper end being adjustably attached to a forearm support;

a forearm support comprising a handle and a forearm cuff, the handle being tilted downward by an angle of between about 0–40 degrees, and further being inclined inwardly toward the user by an angle of between about 0–20 degrees, the handle and forearm cuff being linearly adjustable with respect to each other about a longitudinal axis thereof, the forearm cuff including a forearm cradle, substantially congruent with an ulnar surface of a forearm, and a restraining means for securing said forearm therein;

an angular support means to adjustably secure said upper end of the vertical elongate shaft to the forearm support assembly whereby said forearm support assembly can be adjusted about a range of about 25 to 89 degrees relative to the vertical support the vertical elongate support being attached to the forearm support at a point intermediate to said handle and posterior to a substantial portion of said cradle;

a shock absorbing means, intermediate to the vertical shaft and the forearm support and wherein;

at least 30 percent of the user's body weight is transferred to said walking surface through the forearm support.

15. The walking aid of claim 14 and further including an intermediate shaft, in mechanical communication with an intermediate to the upper and lower shafts, and in telescoping contact with at least one of the upper and lower shafts whereby the vertical support is adjustable in length.

16. In a walking aid of the type having a forearm support and vertical support, the improvement comprising:

a linearly disposed handle and forearm cuff, the handle being tilted downward by an angle of between about 0–40 degrees, and further being inclined inwardly toward the user by an angle of between about 0–20 degrees, the handle and forearm cuff being linearly adjustable with respect to each other about a longitudinal axis thereof, the forearm cuff including a forearm cradle, substantially congruent to an ulnar surface of a forearm, and a restraining means for securing said forearm therein;

the vertical elongate support including an upper shaft in contact with the forearm support, a lower shaft for contacting a walking surface, and an intermediate shaft, intermediate to and in contact with the upper and lower shafts and in telescoping contact with at least one of the upper and lower shafts whereby the vertical support is adjustable in length, the vertical support further including a compressible shock absorbing means;

an angular support means to adjustably secure said upper end of the vertical elongate shaft to the forearm support assembly about a point intermediate to the handle and the forearm support, whereby said arm support assembly can be adjusted about a range of about 25 to 89 degrees relative to the vertical support; and wherein at least 30 percent of the user's body weight is transferred to said walking surface through the forearm support.

17. The walking aid of claim 16 wherein at least about 40 percent of the user's body weight transmitted to a walking surface by the forearm support.

18. The walking aid of claim 16 wherein said downward tilt and inward inclination of the handle urges an ulnar border of the user's hand to be pronated about five degrees, and an ulnar deviation of about fifteen degrees.

* * * * *